United States Patent [19]

De Castro

[11] Patent Number: 4,807,851

[45] Date of Patent: Feb. 28, 1989

[54] PROCESS FOR LIFTING TANKS

[75] Inventor: Bruno De Castro, Miami, Fla.

[73] Assignee: United Tank Lifting Technologies, Inc., Miami, Fla.

[21] Appl. No.: 142,125

[22] Filed: Jan. 11, 1988

[51] Int. Cl.[4] ..... B66F 1/08

[52] U.S. Cl. ..... 254/1; 254/89 H

[58] Field of Search ..... 254/89 H, 89 R, 105, 254/108-111, 1

[56] References Cited

U.S. PATENT DOCUMENTS

| | | | |
|---|---|---|---|
| 3,033,411 | 5/1962 | Brucker et al. | 254/89 H |
| 3,182,958 | 5/1965 | Peterzon | 254/89 H |
| 3,211,427 | 10/1965 | Briston | 254/89 H |
| 3,881,687 | 5/1975 | Johansson | 254/89 H |

*Primary Examiner*—Robert C. Watson

*Attorney, Agent, or Firm*—Jesus Sanchelima

[57] ABSTRACT

A process for lifting tanks where several hydraulic jack assemblies are positioned adjacent to the external peripheral wall of the tank and, if the tank has large dimensions, additional hydraulic jack assemblies are positioned inside the tank. After the jack assemblies are secured to the tank structure, the lifting operation is begun. The jack assemblies provide the necessary lifting force from a substantial hydraulic pressure and relatively small displacement. The jack assemblies are inverted so that the housing is lifted while the rod stays stationary. After complete distension, log members are inserted below the lowermost end of the jack housing and the rod retracted. Then, an additional log member is inserted below the retracted rod and the lifting operation renewed.

2 Claims, 6 Drawing Sheets

PROCESS FOR LIFTING TANKS

BACKGROUND OF THE INVENTION

1. Field of the Invention

The present invention relates to a process and apparatus for lifting storage tanks.

2. Description of the Related Art

Large storage tanks, like the ones commonly found in refineries for storing oil, require maintenance from time to time. To access the bottom of the tank, the latter must be lifted off the supporting floor. This operation involves temporarily draining the tank. The time used for repairing the tank constitutes a waste of an expensive asset. Therefore, the lifting of these tanks must be accomplished in a safely and expeditious manner.

Applicant believes that the closest reference corresponds to U.S. Pat. No. 3,033,411 issued to J. Brucker et al on May 8, 1962. Brucker's apparatus involves the use of several hydraulic lifts adapted to exert an upward pressure on brackets carried by the outer periphery of the cylindrical wall, and a set of catenary suspension systems extending radially about the axis of the tank for the simultaneous lifting of the floating roof. The capacity of the jacks that would have to be used with this appparatus would be enormous specially if the tank is to be lifted a sufficient distance to allow the maintenance crew work on its bottom. Also, the outer surface of the peripheral wall of the tank need to have been provided with complementary means that cooperate with brackets provided with the jacks.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a process and apparatus for lifting large storage tanks in an efficient, fast manner with a minimum of risk of destroying or affecting the structural integrity of the tank being lifted.

It is another object of this present invention to provide a process and apparatus for lifting large storage tanks that requires a minimum number of operators while at the same time safely accomplishes the tank.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
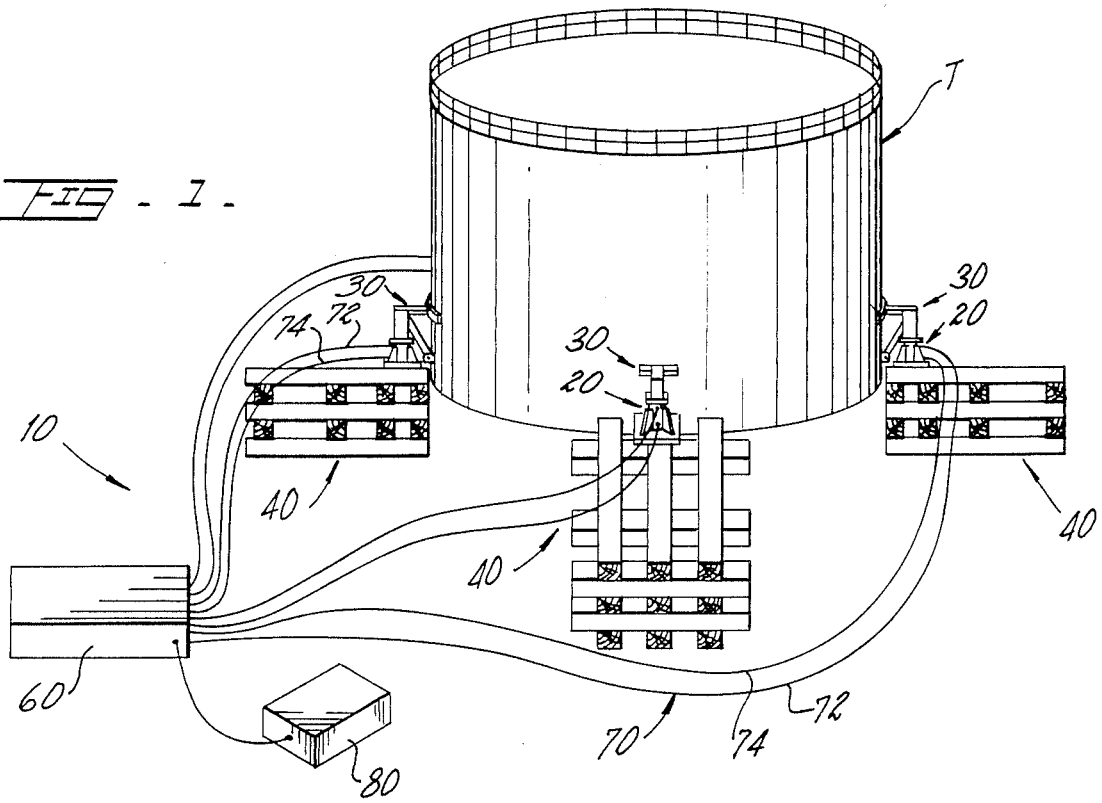
FIG. 1 represents a reservoir tank being lifted with a process and apparatus of the present invention.

Referring now to FIG. 1, where the present invention is generally referred to with numeral 10, it can be observed that it basically includes several inverted hydraulic jack assemblies 20 adapted to exert an upward force on the outer surface S of storage tank T. A typical tank T includes a peripheral wall and a bottom. Most of them have a cover. There are primarily two types of covers: a fixed cover and a floating cover. Typically, with the passage of time, oil and other deposit tanks need to be lifted and maintenance operations performed. Corrosion eats the bottom of these tanks and it is necessary to lift them to be able to effectively work on them (sand blasting, painting, removing the soil, placing a liner, etc.).

In FIG. 1, only the external lifting jack assemblies 20 are shown but, depending on the size of tank T, additional lifting assemblies may be utilized inside tank T to insure the uniform lifting of tank T. A set of logs or wood members 40 support jack assemblies 20 and the logs are selectively added or removed to elevate or lower them. The area where log members 40 are installed must be leveled to insure a horizontal and uniform plane around the tank. Hydraulic pump assembly 60 is connected to jack assemblies 20 providing the necessary hydraulic fluid under pressure through conduit members 70 and being controlled by control assembly 80.

Figure 2:
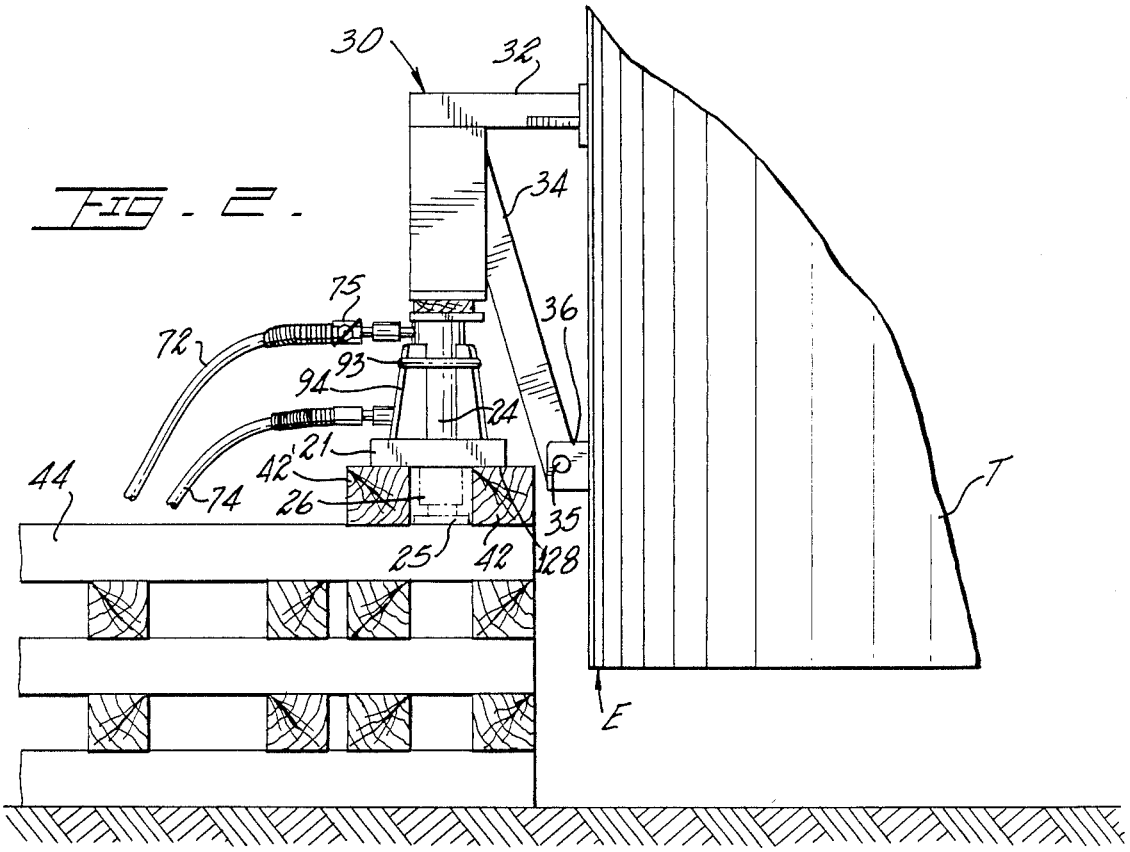
FIG. 2 shows a section of the representation of FIG. 1.

As best shown in FIG. 2, an inverted hydraulic jack assembly 20 include inverted jack member 22 that lifts tank T from the outer peripheral walls. Other hydraulic jack assemblies 20 may be used in selected places inside tank T in order to uniformly lift it. Once a given height is achieved, as shown in FIG. 2, jack assemblies 20 may be positioned directly below edge E thereby dispensing the use of bracket assemblies 30.

Figure 3:
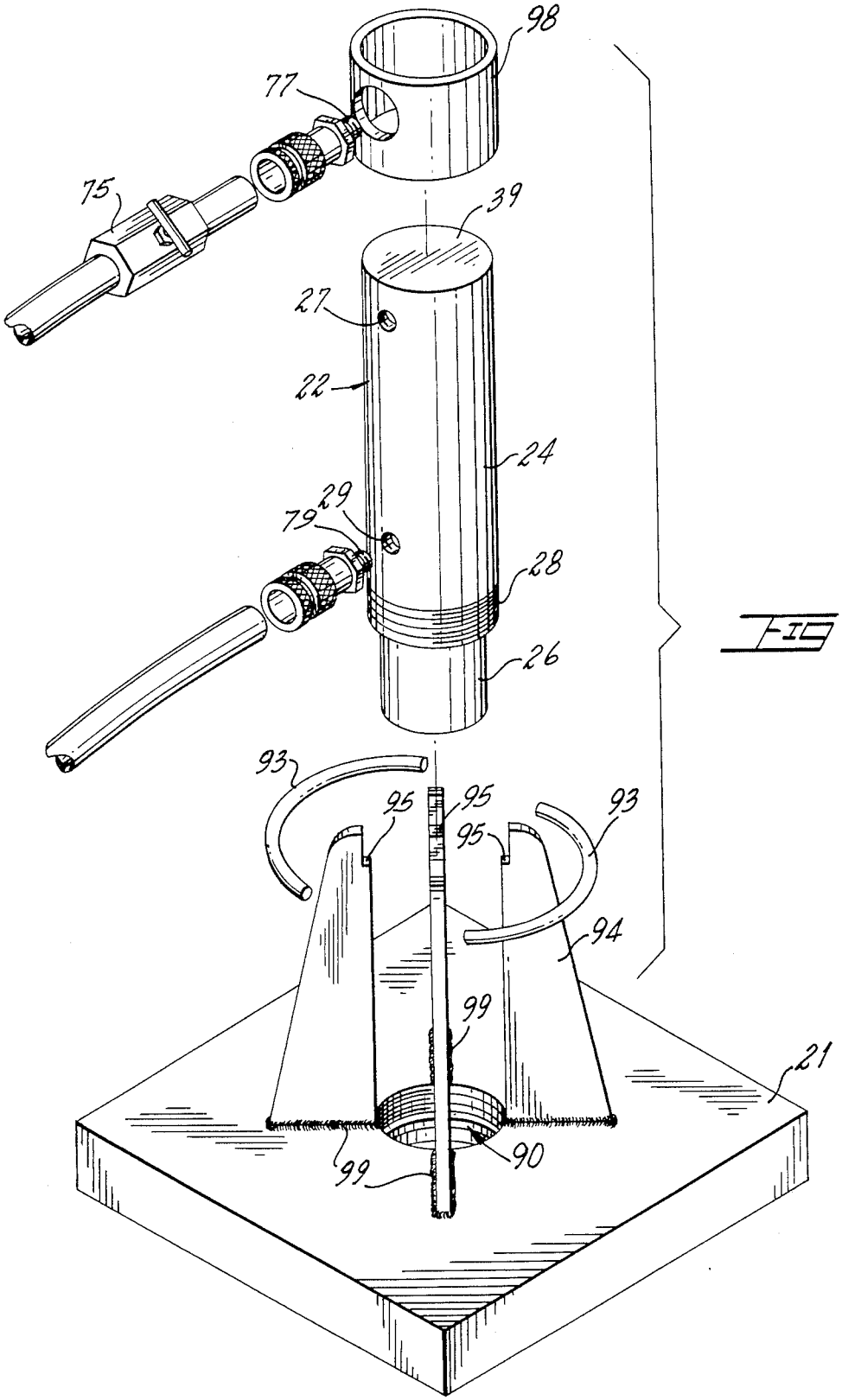
FIG. 3 illustrates a disassembled view of the inverted hydraulic jack used in the present invention.
Figure 5:
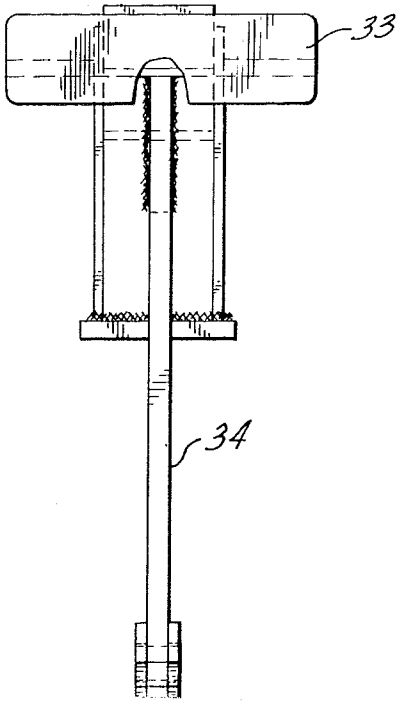
FIG. 5 represents a rear view of the support bracket assembly taken along line 5—5 in FIG. 4.
Figure 4:
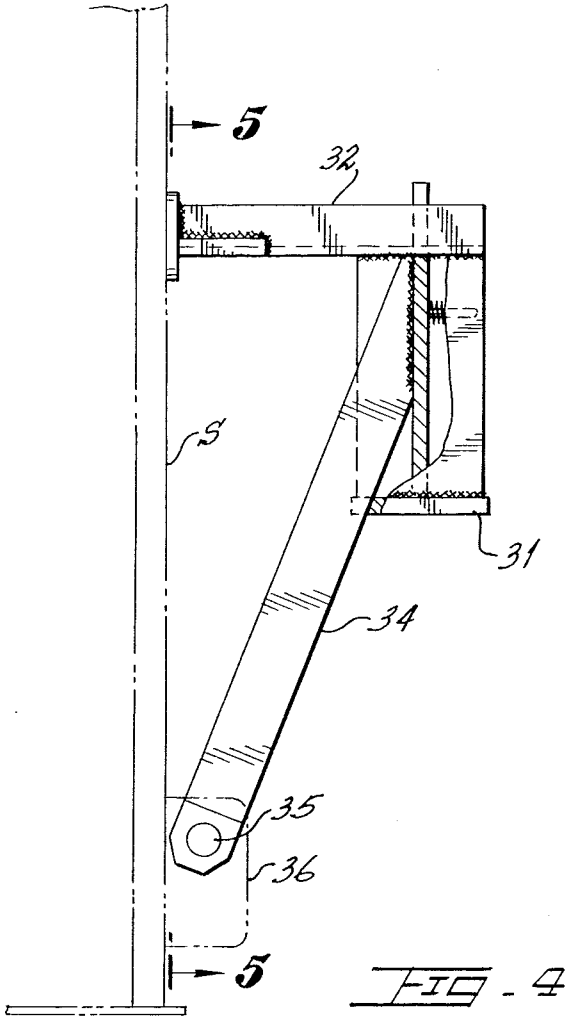
FIG. 4 shows a side view of the support bracket assembly installed on a section of the lateral outer wall of a tank.

Cylindrical body or housing 24 is screwed on base member 21 and rod 26 is hydraulically pushed out downwardly, as shown in FIGS. 2 and 3. Openings or ports 27 and 29 through housing 24 tightly receive connectors 77 and 79 to allow the hydraulic fluid in and out of jack member 22.

Housing 24 includes a threaded portion 28 that mates with threaded opening 92. Base member 21 has preferably a rectangular (or square) shape with a threaded through opening 92 adjacent to its upperside, as shown in FIG. 3. The threaded opening 92 does not go through completely but rather terminates substantially around the middle of the thickness of base member 21. An internal flange 190 is positioned at the lowermost end of said threaded portion 92 and it is intended to provide complementary support to housing 24 so that the load rests on the engagement of theads 28 and 92 and on the upper surface of flange member 190.

Four upwardly extending guide members 94 are rigidly mounted on the upperside of base member 21 to receive housing 24. Reinforcement members 93 are soldered to the outer edge of members 94 to further secure housing 24 in place. Members 94 include a notch 95 on their upper ends to fittingly receive band member 98. Guiding members 94 are preferably soldered at 99 to the upperside of base member 21. Band members 98 fits around the upper portion of housing 24 and provides a surface for soldering the tips of guide members 94. Guide members 94 can not be soldered directly to housing 24 without damaging the seals inside hydraulic jack member 22.

Figure 6:
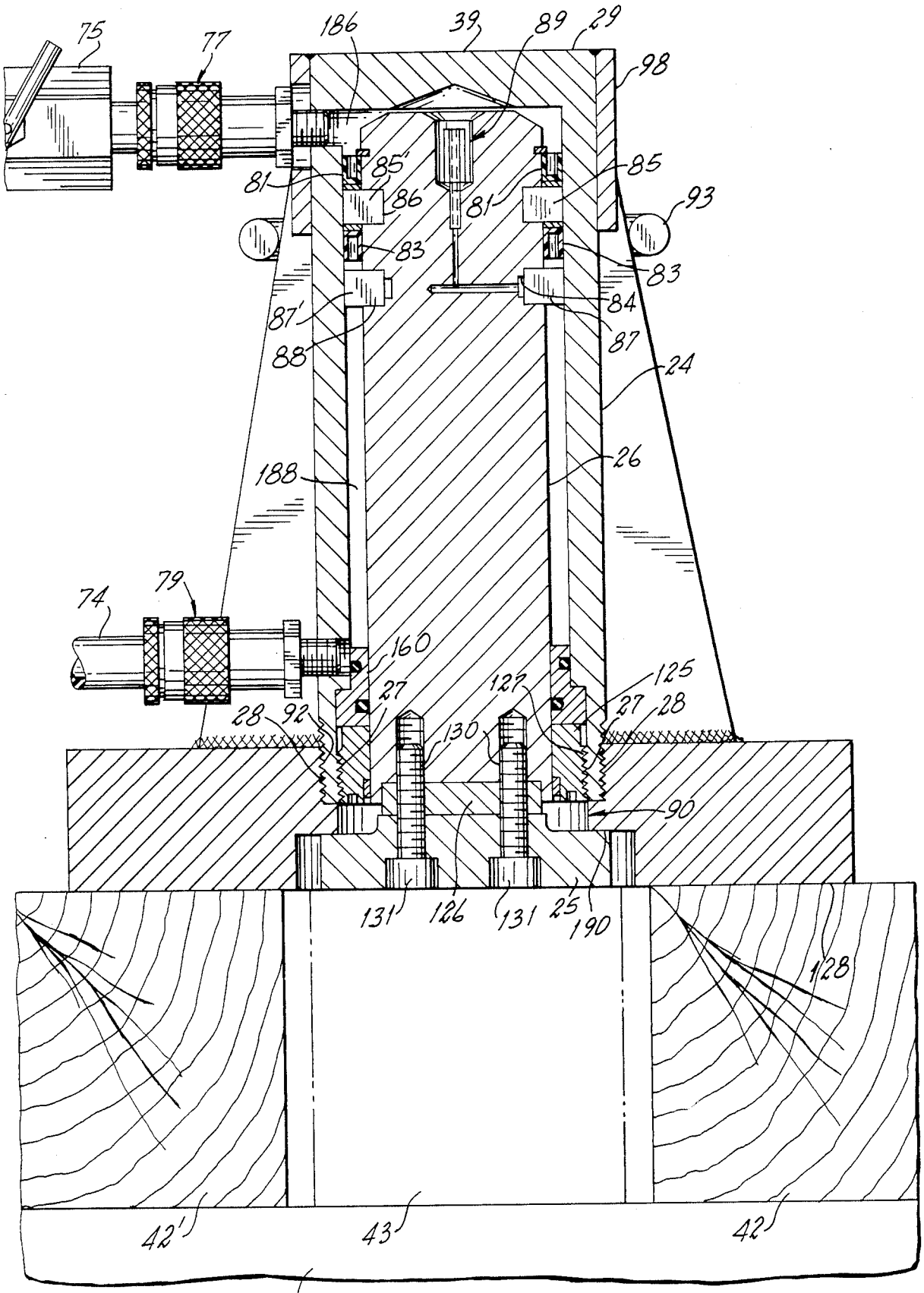
FIG. 6 is a cross-sectional representation of a hydraulic jack in accordance with the present invention.

Base member 21 includes a central through opening 90 and is also provided with a sufficiently large bottom surface 28 to lean on neighboring wood members 42 and 42' on both sides of foot member 25 mounted at the lowermost end of rod 26 and perpendicularly disposed with respect to wood members 44 immediately below, as seen in FIG. 2. When rod 26 is fully distended, logs 42 and 42' are inserted below bottom surface 28 and sandwiching foot member 25. Then, rod 26 is retracted thereby causing jack member 22 and its load to lean on logs 42 and 42' which come in contact with bottom surface 28. When rod 26 has been retrieved completely inside housing 24, another log 43 is inserted beneath foot member 25. During lifting operation, conduit 72 pumps the hydraulic fluid into jack member 22 through safety valve 75. Safety valve 75 prevents any abrupt loss of pressure caused by a rupture of conduit 72. Safety valve 75 is a one-way valve that also functions as a purging valve when it is opened to allow the air out. Jack member 22 is preferably a double action jack and hydraulic fluid is simultaneously displaced out through conduit 74 as the fluid comes in through conduit 72. Refer to FIGS. 2 and 6. In performing this operation, sealing members 81 and 83 inside jack member 22 need to be replaced periodically as they wear out. Locking members 85; 85'; 87 and 87' are pairs of 180° arcs the keep sealing members 81 and 83 in place and they are mounted partially inside grooves 86 and 88. Groove 88 further includes inner channel 84 that goes completely around rod member 26 and it connects lower compartment 188 of jack member 22 with upper compartment 186 through relief valve assembly 89.

Figure 7:
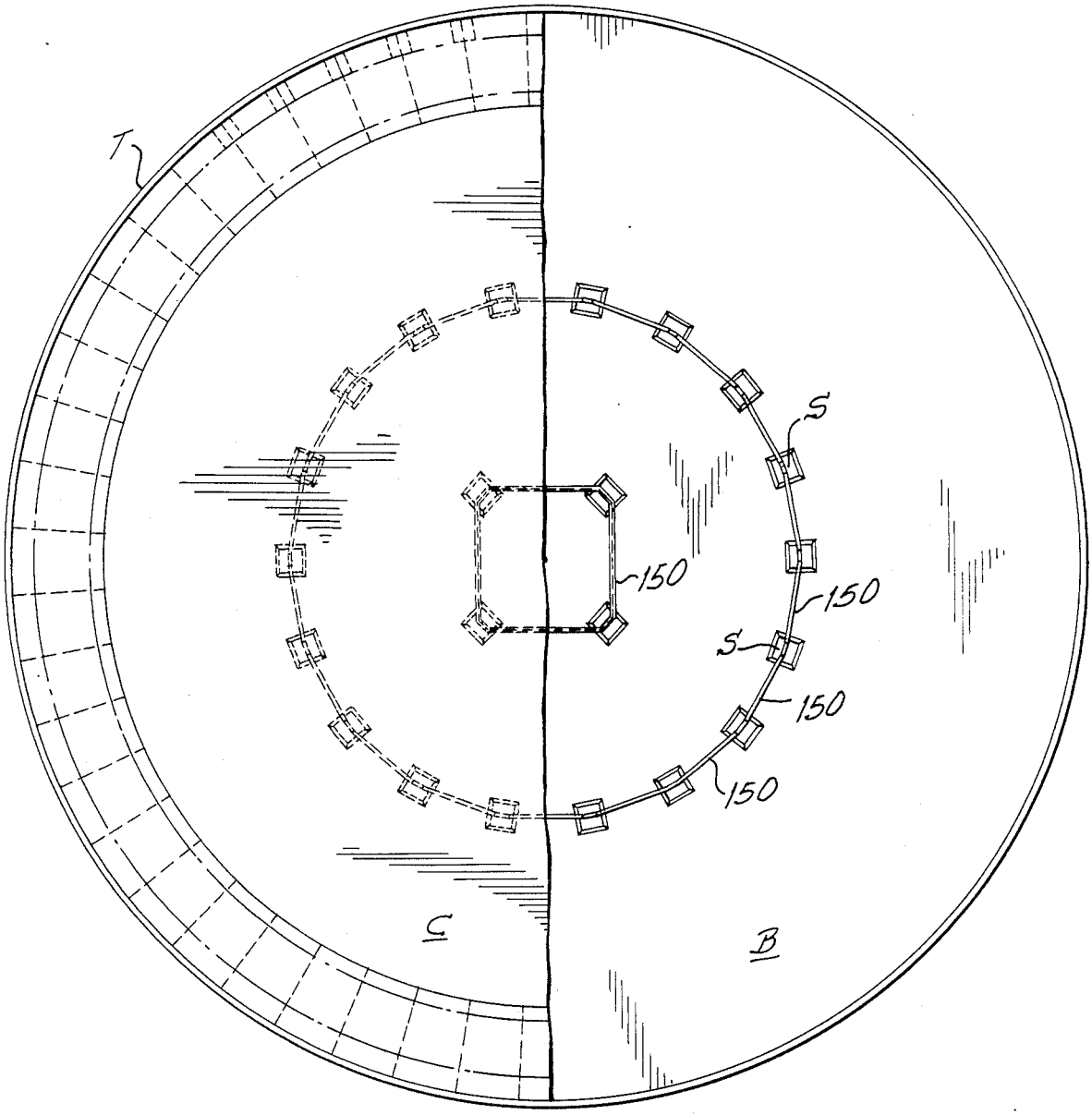
FIG. 7 is a top view of a tank, where the top cover has been partially removed, showing the positions where the hydraulic lifting assemblies are installed to facilitate the uniform lifting of the structure.

Support bracket assembly 30 is rigidly mounted on cap 39 of housing 24. Assemblies 30 are used on the outer peripheral wall of tank T. Other support bracket assemblies are used to lift the T from inside as shown in FIGS. 7; 8 and 9. Assembly 30 includes a substantially horizontally disposed arm 32 and leg member 34 that extends diagonally downwardly from bracket assembly 30 to ear member 36 that is preferably soldered to surface S. Arm 32 presses horizontally and inwardly against surface S upon application of an upward force by jack member 22 through cap 39 on bottom 31. Removable pin 35 provides a pivotal engagement of the lower end of leg 34 with ear 36. Surface 33 at the end of arm member 32 provides the necessary frictional engagement to help in lifting tank T up.

As it can be seen from FIG. 6, housing 24 has, on its lower end, external threaded portion 28 and internal threaded portion 27. Retaining ring member 125 includes an outer threaded portion 127 that cooperatively mates with internal threaded portion 27. Spacer member 126 is positioned below rod member 26 and it includes through holes 130 that allow bolt members 131 through. Members 131 penetrate inside rod member 26 a sufficient distance to provide for a sturdy structural support of shoe member 25 and removably maintain the latter in place. O-ring assembly 160 is mounted between housing 24 and rod member 26 substantially towards the lower end and it is intended to keep the compartments inside housing 24 in an air tight insulation from the atmosphere.

Figure 8:
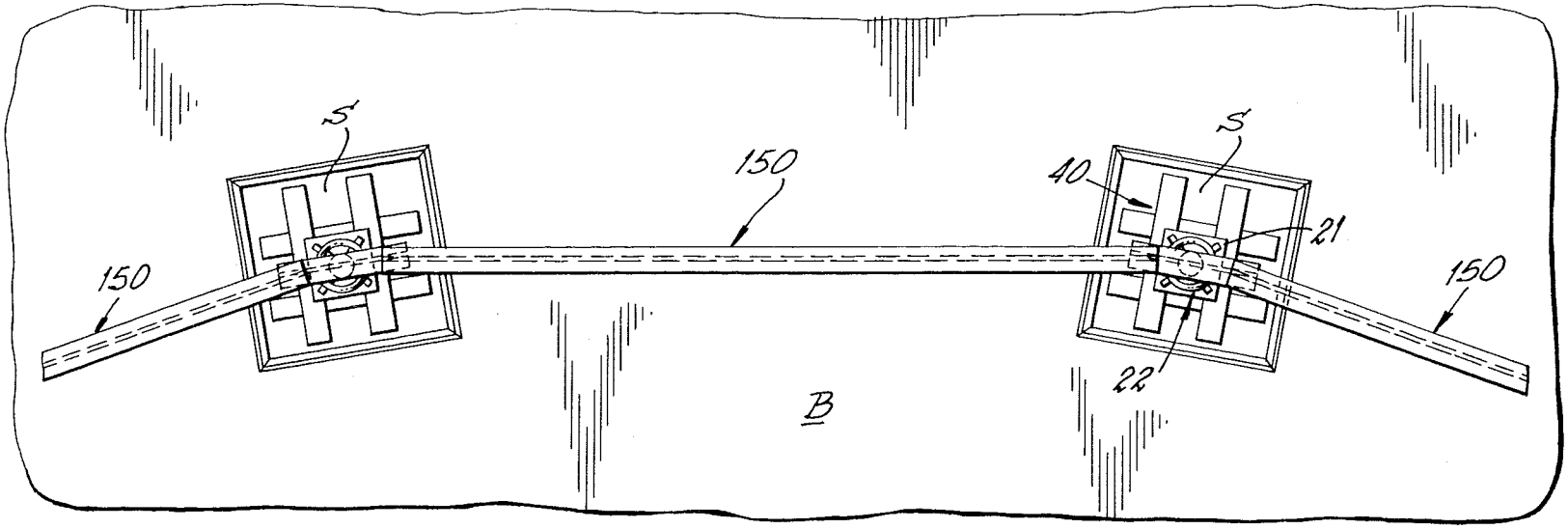
FIG. 8 illustrates two adjoining hydraulic lifting assemblies.
Figure 9:
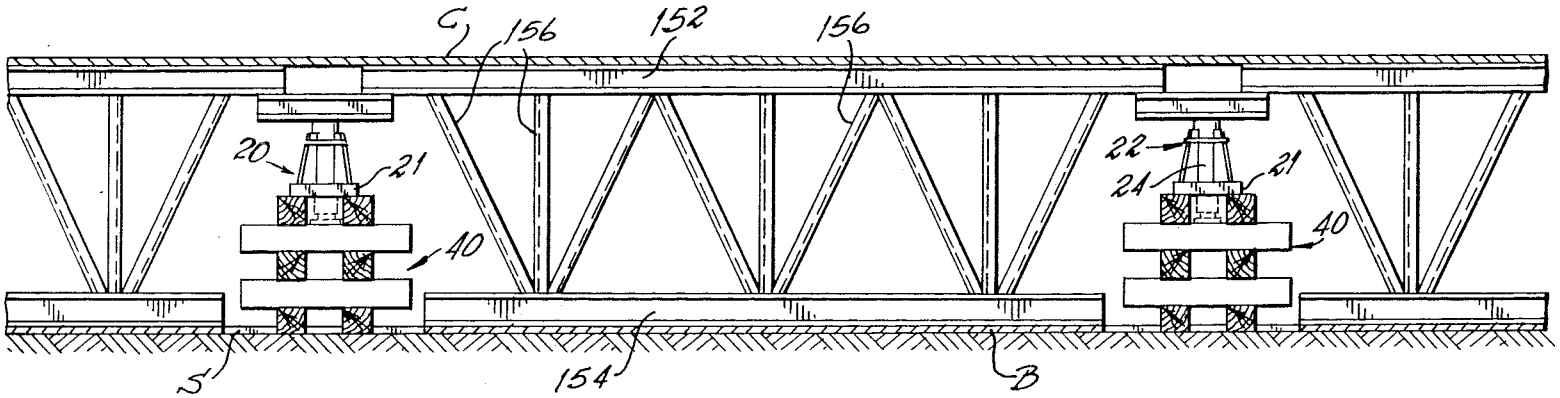
FIG. 9 shows the support structure utilized to each one of said lifting assembly installation.

In FIG. 7, a representation of the preferred positions for the installation of hydraulic jack assemblies 20 with the arrangement of log members as described in FIGS. 1 and 2 is shown. Approximately, one half of the tank is covered with cover C and the other half shows bottom B. Basically, these internal installations are necessary to insure the uniform simultaneous lifting of tank T. Many times these larger tanks have a floating cover that requires the construction of a spacing structure 150 member 154 is secured to bottom B, as shown in FIGS. 8 and 9. Spacing structure 150 member 154 is secured to bottom B includes, basically, an upper longitudinal member 152 and a lower longitudinal member 154 separated a sufficient distance by several spacing structural members 156 to permit jack assembly 20 to be installed in the intersection area of contiguous spacing structures 150 member 154 is secured to bottom B.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A process for lifting a tank, comprising the steps of:

A. securing a plurality of inverted hydraulic jack assemblies to the outer peripheral wall of said tank and said jack assemblies including a rod member and a housing member and said housing member having a lowermost end with sufficient support area adjacent to said rod;

B. activating said jack assemblies in tandem to cause said rod to extend downwardly thereby transmitting an upward force from said housing to said tank;

C. inserting two elongated first log members below said housing and adjacent to said rod so that said jack assemblies rest completely on said first log members when said rod is retracted; and D. inserting a second log member below said retracted rod and in between said first log members so that a suitable supporting area is provided when said rod member is distended protruding downwardly and repeating these operations until said tank is lifted to the desired height.

2. The process set forth in claim 1 further including the steps of:

E. cutting a plurality of sections of the bottom of said tank from the inside; and F. securing a second plurality of inverted hydraulic jack assemblies to the bottom of said tank and said second plurality of jack assemblies including a housing member and a rod member and said housing member having a lowermost end with sufficient support area adjacent to said rod and said jack assemblies resting on the ground exposed from the bottom sections removed so that the lifting operation is accomplished uniformly.

* * * * *